US008984664B2

(12) United States Patent
Moss et al.

(10) Patent No.: US 8,984,664 B2
(45) Date of Patent: Mar. 24, 2015

(54) HELMET BLASTOMETER

(75) Inventors: William C. Moss, San Mateo, CA (US); Michael J. King, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 1033 days.

(21) Appl. No.: 12/499,740

(22) Filed: Jul. 8, 2009

(65) Prior Publication Data

US 2010/0005571 A1 Jan. 14, 2010

Related U.S. Application Data

(60) Provisional application No. 61/079,025, filed on Jul. 8, 2008.

(51) Int. Cl.
*A42B 3/04* (2006.01)
*G01P 15/00* (2006.01)

(52) U.S. Cl.
CPC ..... *A42B 3/046* (2013.01)
USPC ..... 2/6.1; 73/12.09

(58) Field of Classification Search
CPC ..... A42B 3/0433; A42B 3/046
USPC ..... 73/12.01, 12.08
See application file for complete search history.

(56) References Cited

U.S. PATENT DOCUMENTS

| | | | | |
|---|---|---|---|---|
| 3,146,360 A | | 8/1964 | Marshall | |
| 5,164,558 A | * | 11/1992 | Huff et al. | 200/83 R |
| 5,241,518 A | * | 8/1993 | McNelis et al. | 367/127 |
| 6,080,944 A | * | 6/2000 | Itoigawa et al. | 200/61.45 R |
| 6,178,141 B1 | * | 1/2001 | Duckworth et al. | 367/127 |
| 6,925,887 B1 | | 8/2005 | Coffey | |
| 7,311,009 B2 | | 12/2007 | Kotovsky | |
| 7,526,389 B2 | * | 4/2009 | Greenwald et al. | 702/55 |

(Continued)

FOREIGN PATENT DOCUMENTS

| | | | | |
|---|---|---|---|---|
| WO | 2008137934 A1 | | 11/2008 | |
| WO | WO 2008137934 A1 | * | 11/2008 | G01P 1/12 |
| WO | 2009070887 A1 | | 6/2009 | |

OTHER PUBLICATIONS

Author: Brittany Sauser, Title: "Fighting Head Trauma in Iraq", Date: Sep. 18, 2007, Publisher: MIT Technology Review, URL http://www.technologyreview.com/news/408688/fighting-head-trauma-in-iraq/, pp. 1-2.*

(Continued)

*Primary Examiner* — Harshad R Patel
(74) *Attorney, Agent, or Firm* — James S. Tak

(57) ABSTRACT

A helmet blastometer for characterizing the direction, speed, magnitude, and duration of a blast event to determine the likelihood of blast-induced traumatic brain injury (biTBI). Time of arrival (TOA) gage sensors are mounted on a rigid outer shell of the helmet each producing a TOA signal in response to a fast rising blast induced positive pressure change above a predetermined threshold. A receiver analyzes the positive pressure changes from the gages to determine direction, speed, and magnitude of a blast. Other TOA gauge sensors can be used to produce a TOA signal in response to a negative pressure change below a predetermined threshold. The positive and negative pressure change TOA signals are used to determine blast duration. A second set of internal contact pressure sensors is connected to an inner liner of the helmet to detect contact pressure on a user's head to determine if biTBI has been sustained.

20 Claims, 6 Drawing Sheets

(56) References Cited

U.S. PATENT DOCUMENTS

| | | | | |
|---|---|---|---|---|
| 2007/0089480 | A1 | 4/2007 | Beck | |
| 2008/0173960 | A1 | 7/2008 | Kotovsky | |
| 2012/0188083 | A1 * | 7/2012 | Miller, II | 340/573.1 |

OTHER PUBLICATIONS

Authors: Gilbert F. Kinney and Kenneth J. Graham, Title: Explosive Shocks in Air, Date: 1985, Publisher: Springer-Verlag, Edition: second, Pertinent pp. 4-7, 90-91 and 188-191, Additional Pages of Interest Though Not Cited: 56-57 and 94-101.*

* cited by examiner

HELMET BLASTOMETER

CLAIM OF PRIORITY IN PROVISIONAL APPLICATION

This application claims the benefit of U.S. Provisional Application No. 61/079,025 filed Jul. 8, 2008, entitled, "Helmet Blastometer for In-theater Diagnosis of Blast-Induced Traumatic Brain Injury."

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to blast sensors, and in particular to a helmet blastometer for characterizing the direction, speed, magnitude (peak pressure), and duration of a blast event for determining the likelihood of blast-induced traumatic brain injury (biTBI).

BACKGROUND OF THE INVENTION

The advent and use of body armor has substantially reduced fatalities from explosions, especially soldier fatalities from explosive attacks. Lower mortality rates from primary injuries, such as fragments, however have been accompanied by a significant rise in the incidence of other injuries, such as blast-induced traumatic brain injury (hereinafter "biTBI"). Such injuries can be difficult to diagnose since symptoms can appear long after exposure to a blast, and injured victims often self-report immediately after the blast that they are fine.

It is known that the human body's ability to tolerate increases in external pressure above the ambient pressure depends on (1) the rate of pressure increase; (2) the peak value (i.e. magnitude) of the pressure increase; and (3) the duration of the pressure increase. In general, slow increases in pressure are tolerated well, even for long durations. For example, a scuba diver descending slowly (over many tens of seconds) to 120 feet will experience an additional four atmospheres of external pressure, with no deleterious effects at depth. However, serious injury can occur when the pressure rises rapidly (microseconds or less), as in a blast wave. It is appreciated that a blast wave in air is a rapidly moving pressure wave exceeding many hundreds of meters per second that produces a sudden increase in pressure above the ambient pressure. FIG. 9 shows an amplitude vs. time graph of a typical blast wave in air. The sudden increase (rapid rise time) in pressure that exceeds the ambient pressure, especially one that is induced by a shock or blast wave, is called overpressure. After the blast wave passes a particular location, the blast-induced overpressure decreases slowly (relative to the rise time) from the peak value (magnitude) to values that for a short time fall below the original ambient pressure. The pressure eventually returns to the ambient value long after the blast wave has passed. In FIG. 9, the blast duration is illustrated as the difference in trigger time or TOA between the positive pressure change above ambient pressure and a negative pressure change below ambient pressure.

In general, the greater the magnitude of the blast-induced overpressure and the longer the duration of the blast-induced overpressure, the more severe the biological damage due to the blast wave. For example, a few atmospheres of blast-induced overpressure experienced for a few milliseconds is known to cause severe biological damage. The severity of the problem is compounded because simulations have shown that even small overpressures with rapid rise times can produce significant flexure in the skull (a previously unrecognized/unreported mechanism), which can generate large pressure gradients in the brain that may be a primary mechanism for biTBI).

Diagnosis of biTBI is problematic because precise biological damage thresholds are not currently known, and blast exposure is affected significantly by a blast victim's (e.g. soldier's) local environment. For example, blast exposure in an unconfined space is much less severe than in an enclosed space, or near a wall or interior corner, and can also differ from conditions inside a vehicle. Consequently, it is difficult to determine the severity of the blast wave to which a blast victim has been exposed. This makes determination of biological damage thresholds from field injury data challenging. And even if these thresholds were known, they cannot be used to diagnose biTBI unless the exact blast conditions experienced by a particular individual can be measured. The objective determination of the severity of blast effects requires assessment during the exposure.

What is needed therefore is a helmet blastometer for determining blast conditions that give rise to biTBI, such that the diagnosis of biTBI can be objective rather than subjective.

SUMMARY OF THE INVENTION

One aspect of the present invention includes a helmet blastometer comprising: a helmet having a rigid outer shell; a plurality of external sensors connected to the rigid outer shell at various locations thereof, with each external sensor comprising a time-of-arrival (TOA) gage that produces a TOA signal in response to a blast-induced positive pressure change above a predetermined threshold pressure ("positive-pressure-change TOA signal"); and a receiver operably connected to receive the TOA signals from the TOA gages.

Another aspect of the present invention includes a helmet blastometer comprising: a helmet having a rigid outer shell and an inner liner which spaces the rigid outer shell from a user's head; a plurality of external sensors connected to the rigid outer shell at various locations thereof, with each external sensor comprising a time-of-arrival (TOA) gage that produces a TOA signal in response to a blast-induced positive pressure change above a predetermined threshold pressure ("positive-pressure-change TOA signal"), and at least one of the external sensors is a dual-gage external sensor further comprising a second TOA gage that produces a TOA signal in response to a blast-induced negative pressure change below a predetermined threshold pressure ("negative-pressure-change TOA signal"); a plurality of internal sensors connected to the inner liner at various locations thereof, with each internal sensor comprising a contact stress gage which measures contact stress between the inner liner and the user's head and produces a corresponding contact stress signal; and a receiver operably connected to receive the TOA signals from the TOA gages and the contact stress signals from the contact stress gages.

Generally, the present invention is directed to a helmet blastometer capable of detecting pressure changes in a surrounding blast environment from various sensing locations on the helmet, to detect and characterize a blast event by determining the direction, speed, magnitude (peak pressure), and duration of the blast event. A set of external sensors, each having one or more time of arrival (TOA) gages is mounted on or otherwise connected to the helmet at various spatially separated exterior locations thereof (preferably on a rigid outer shell of the helmet) and used to produce a TOA signal in response to a detected fast rising, blast-induced pressure change satisfying a predetermined threshold condition. In particular, each external sensor includes a positive-pressure-change TOA gage that is responsive/sensitive to a positive pressure change above a predetermined threshold pressure (e.g. ambient pressure) and produces a positive-pressure-change TOA signal when triggered. In addition, one or more of the external sensors is preferably a dual-gage sensor which includes an additional negative-pressure-change TOA gage that is responsive/sensitive to a negative pressure change below a predetermined threshold pressure (e.g. ambient pressure) and produces a negative-pressure-change TOA signal when triggered. Each of the predetermined threshold pressures may be chosen other than ambient pressure to account for pressure changes due to weather or altitude.

The TOA gages used in the present invention are of a type capable of registering the trigger/arrival time of a positive (or negative) pressure phase (relative to a predetermined threshold pressure) in ambient fluid pressure, but they need not record the pressure history with a great deal of accuracy, as long as the time of the pressure increase or decrease is reported accurately. Various types of TOA gages known in the art may be utilized for the external sensors. In particular, small scale pressure sensor technology that is commercially available off the shelf may be suitable for this application. For example, small MEMS device TOA gages may be used which are similar to pressure gages, but are not as complex. In one particular example, Kotovsky contact stress sensors of a type disclosed in U.S. Pat. No. 7,311,009 (incorporated by reference herein) may be used with a small modification to convert it into a TOA gage. In particular by sealing the chamber below the diaphragm during the manufacturing process, this would make it suitable as a TOA gage, i.e. the Kotovsky sensor would detect changes in pressure, not contact stress.

The TOA signals (positive-pressure-change signals, or both positive- and negative-pressure change signals) are sent to and received by an onboard receiver, which may for example be an IC chip that contains system power (e.g. a Li battery), data recording and storage, and optional data processing/computing electronics (e.g. firmware) to analyze the TOA trigger signals. Depending on the purpose and use of the helmet blastometer (e.g. helmet certification testing, field studies of biological damage/injury thresholds, or in-theater diagnosis and reporting of user biTBI likelihood), the signals may be stored in local data storage for later download, transmitted to a remote system/storage, or processed onboard to analyze and characterize a blast event.

Where blast characterization and analysis is desired (such as for real-time diagnosis and reporting of biTBI likelihood), the receiver processor may be used to determine blast presence (event discrimination), blast direction, blast velocity, blaster overpressure magnitude (i.e., peak pressure), and blast duration. Temporal correlations between all the sensors can be used to determine the presence of a blast event, the blast direction, and the blast velocity (since the relative distances between the external sensor positioned are known). First, the temporal correlations would be used to determine the presence of a blast and ensure that false-positives from abrupt accelerations, such as from shrapnel impacts or simply dropping the helmet, are discriminated against and not recorded (as having time interval signatures that are inconsistent with blast wave speeds). Blast directionality (i.e., plane of motion) can be determined by vector analysis based on the time intervals and relative positions of the external sensors which are known. Because the skull does not have a uniform thickness, its response to blast may be direction-dependent. And blast velocity can also be easily determined from the time intervals and relative distances between external sensors (i.e., the orthogonal distances between external sensor planes which are parallel to the plane of motion of the blast wave).

The magnitude (peak pressure) of a blast is determined by the receiver processor using the blast velocity since the speed of a blast wave in air is strongly dependent on the magnitude of the overpressure. An approximation of the relationship may be written as:

$$U_s = c_o\left(1 + \frac{6P}{7P_o}\right)^{0.5}$$

where $U_s$ is the blast velocity, $c_o$ is the ambient sound speed in air, $P_o$ is the ambient pressure, and P is the overpressure magnitude/peak pressure. Typical values range from 333 m/s, when P=0, to 620 m/s when P=3 atm. Thus, by measuring the time interval between signals from the positive pressure TOA gages, the wave speed, and hence the magnitude of the blast, can be determined. The sensitivity needed to measure the pressure is well within the spatio-temporal resolution of the set of externals sensors. For example, it takes about 80 μs for a 600 m/s blast to travel between TOA gages spaced at 5 cm. A sonic wave would take nearly twice as long. The advantage of using this approach to measure blast magnitude, as opposed to the direct use of pressure gages, is that TOA gages are easier to build, more robust, and less expensive than calibrated pressure gages.

And blast duration may be also be determined by the onboard receiver processor based on a time interval between the positive-pressure-change TOA signal and the negative-pressure-change TOA signal received from the same external sensor. The second TOA gage of an external sensor will respond only to negative pressures, relative to certain thresholds, to measure the time of arrival of the negative phase of the blast wave. The difference in time between the triggering of both gages of a particular sensor gives the blast duration.

Furthermore, the receiver processor may also make a further determination, based on one or more of the blast measurements obtained from the external sensors and compared against corresponding predetermined blast thresholds/criteria, that blast induced traumatic brain injury (biTBI) has likely been sustained, and provide a warning signal of the injury, such as using a visual, aural, or other indicator (e.g., an RF signal). When the criteria for injury or dangerous exposure are met, this determination would preferably produce a Yes-No response based on known biological damage thresholds.

In addition to the set of external sensors, internal pressure changes at the interface between the helmet and a user's head/skull, may also be monitored with a set of internal sensors, each being a contact stress gage mounted on or otherwise connected to an inner liner of the helmet at various spatially separated locations thereof which measures contact stress (pressure) between the inner liner and a user's head/skull and produces a corresponding contact stress signal. One exemplary type of contact stress gages suitable for the internal sensors may be the Kotovsky contact stress sensors discussed above, but without modification. It is appreciated that helmets are typically constructed having two main components, a rigid outer shell, and an inner liner which suspends/spaces the rigid outer shell from a user's head. The inner liner is typically used to provide standoff, comfort, protection (impact absorption), and stability. The inner liner itself can comprise one or more components, including padding (e.g., foam padding), suspension straps (e.g., leather), or some combination of both, and may either be integrally formed on the inside surface of the rigid outer shell or provided as a removable insert (e.g., M1 military helmet). The internal sensors are preferably positioned on the inner liner either directly in contact with the user's head, or spaced from the user's head and coming into contact with the user's head only in an impact/blast event.

Various applications for the helmet blastometer may include, but not limited to, the following. For example, one exemplary application of the helmet blastometer of the present invention is in-theater military or police applications, or any other application employing safety helmets (e.g., recreational activities/sports). In this case, the helmet blastometers would preferably include both sets of internal and external sensors to measure blast environment and determine/diagnose if a user (e.g., soldier) had been exposed to critical blast load based on known injury thresholds. Another exemplary application of the helmet blastometer may be for blast test certification of helmets. Current helmets are not certified in any way for protection from blasts. The helmet blastometer system could be used to "blast certify" helmets during the design/testing phase of helmet development, i.e., to determine if the helmet satisfies minimum head protection standards (e.g., load transfer limits: how well the helmet absorbs impact, shock or blast wave) as may be considered safe (sufficient protection) by the military &/or medical community.

BRIEF DESCRIPTION OF THE DRAWINGS

The accompanying drawings, which are incorporated into and form a part of the disclosure, are as follows.

DETAILED DESCRIPTION

Figure 1:
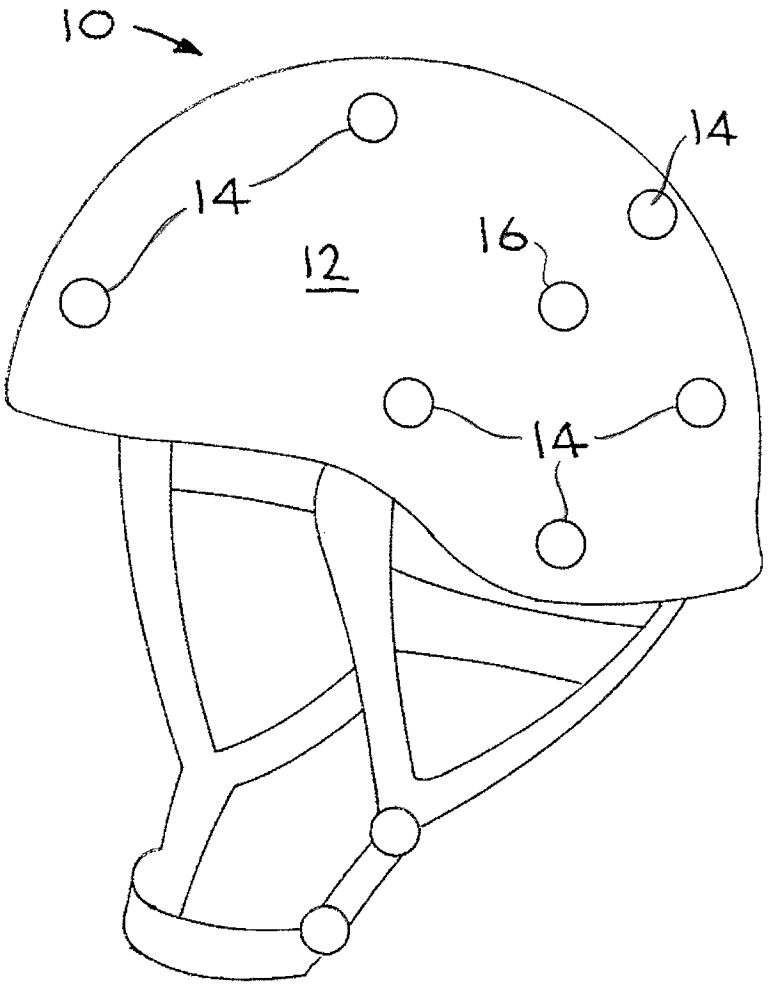
FIG. 1 is a perspective view of an exemplary helmet blastometer of the present invention having a set of external sensors.

Turning now to the drawings, FIG. 1 shows a first exemplary embodiment of the helmet blastometer of the present invention, generally indicated at reference character 10. The helmet blastometer 10 is shown having three main components, a helmet 12, a set of external sensors 14 connected to the helmet and capable of sensing pressure changes in a blast environment external to the helmet so as to characterize the blast environment, and a receiver (not shown in FIG. 1, see 59 in FIG. 7) which includes the electronics for receiving the signals produced by the external sensors. In addition, the receiver may also include electronics for storing, processing, and analyzing the received signals, as well as for controlling/powering system operations, and remote communicating with offboard systems if necessary. Also shown in FIG. 1 is a biTBI warning indicator 16, which may be any type of warning indicator including, a visual indicator (e.g. color based), an aural indicator (e.g. sound alarm), or other signal generator, such as an RF signal transmitter.

In one exemplary embodiment, each of the external sensors 14 are comprised of a time of arrival (TOA) gage that produces a TOA signal in response to a blast-induced positive pressure change above a predetermined threshold pressure. As used herein and in the claims, this particular TOA signal is called a "positive-pressure-change TOA signal," and the TOA gages is called a "positive-pressure change TOA gage." The positive-pressure-change TOA signals are sent to the receiver (see 59 in FIG. 7) stored, processed, and/or transmitted to a remote location. Preferably four or more external sensors, each with a positive-pressure-change TOA gage, are used and spaced from each other and positioned on the outside (external) of the helmet so as to characterize the blast environment outside the helmet. As described earlier the positive-pressure-change TOA signals are used by the receiver processor to determine the presence, velocity, directionality, and magnitude (peak pressure) of a blast. Typically, three external sensors with positive-pressure-change TOA gages (at non-collinear sensing points) are required to determine a plane of motion of the blast front (i.e. directionality), and a fourth to get the blast velocity and magnitude (peak pressure). Because the positive-pressure-change TOA gages responds only to positive pressure above a certain threshold pressure, the threshold pressure may be chosen to neglect pressure changes due to weather or altitude. Moreover, one of the external sensors (e.g. a fifth sensor) may be used for waking up the system which may be kept in standby mode to conserve power.

In another exemplary embodiment, at least one of the external sensors 14 is a dual-gage sensor, which includes a second TOA gage that produces a TOA signal in response to a blast-induced negative pressure change below a predetermined threshold pressure. This second TOA gage responds only to negative pressures, relative to certain thresholds, to measure the time of arrival of the negative phase of the blast wave. Blast duration is determined in this embodiment by determining the time interval between the positive-pressure-change TOA signal and the negative-pressure-change TOA signal. Therefore, the addition of at least one dual-gage external sensor would completely characterize the blast environment outside the helmet. As used herein and in the claims, this particular TOA signal is called a "negative-pressure-change TOA signal," and the TOA gage is called a "negative-pressure change TOA gage." Similar to the positive-pressure-change TOA signals, the negative-pressure-change TOA signals are also sent to the receiver (see 59 in FIG. 7) for storage, processing, and/or transmission to a remote location.

Figure 2:
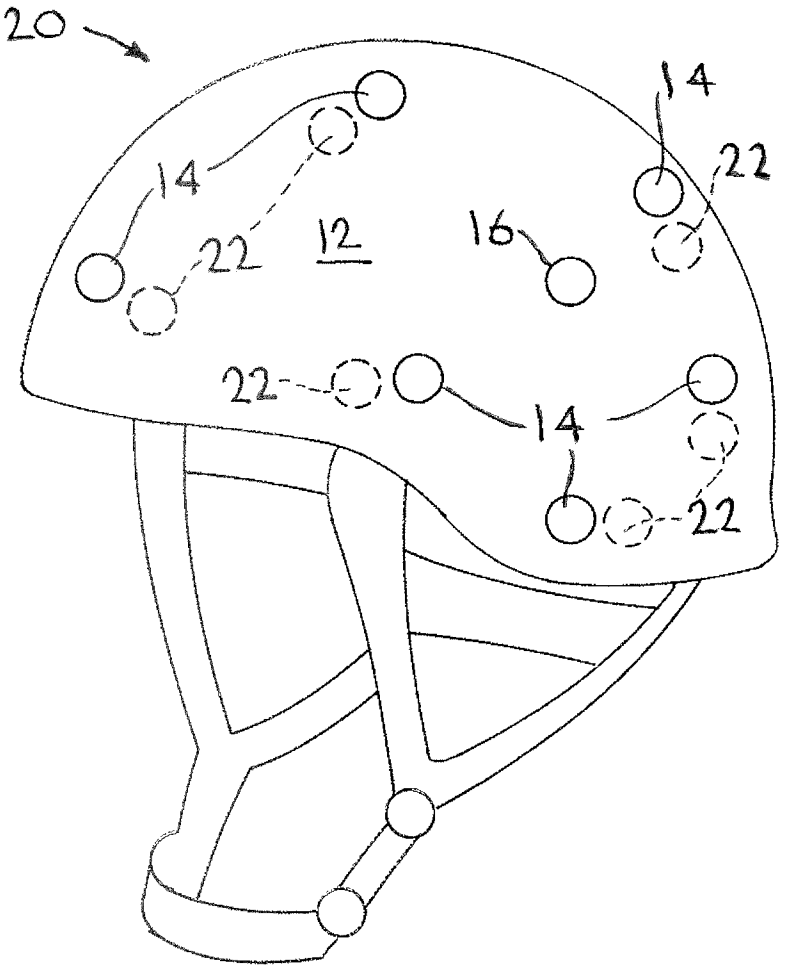
FIG. 2 is a perspective view of an exemplary helmet blastometer of the present invention having both a set of external sensors for characterizing the blast environment, and a set of internal sensors for measuring contact stress on a user's head.

FIG. 2 shows a second exemplary embodiment of the helmet blastometer of the present invention, generally indicated at reference character 20. The helmet blastometer 20 is similar to FIG. 1 in that it shows a helmet 12, a set of external sensors 14, and a warning indicator 16. However, the helmet blastometer 20 in FIG. 2 is shown having a set of internal sensors 22 in addition to the set of external sensors 14, which are capable of sensing contact stress against a user's head/skull. These internal sensors 22 are also connected to the receiver (not shown) to send contact stress signals. The second set of internal sensors are positioned inside the helmet 12 on an inner liner (not shown) as previously described. For example they may be mounted either on the leather head band next to the skull, or on the foam pads near the skull. This set of internal sensors would be used to record the magnitude of the stress that reaches the skull. As such, it could be used to measure how well a helmet design serves to absorb impacts/blasts and prevent being transmitted to the skull. If medical criteria can be established to determine conditions for biTBI, then the internal sensors alone, would in principle, be able to determine if those conditions are present and trigger the biTBI warning signal." Moreover, the internal sensors would also be used initially to acquire the field data that are necessary to link blast conditions to contact stress and TBI.

Figure 3:
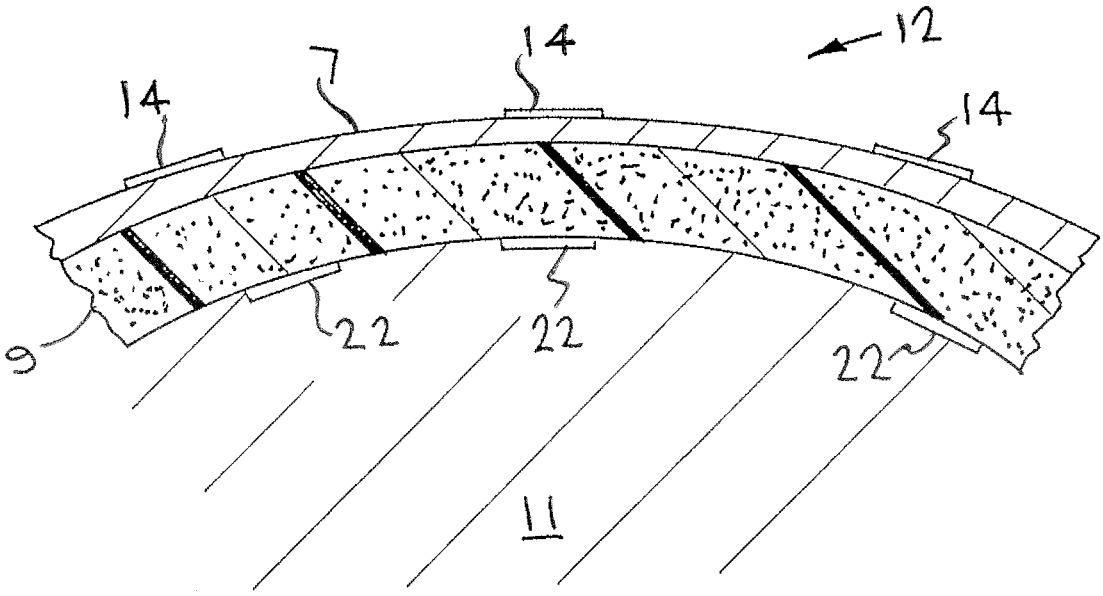
FIG. 3 is a cross-sectional view of a section of the helmet blastometer of FIG. 2, showing the set of external sensors secured to a rigid outer shell of the helmet, and the set of internal sensors secured to an inner liner of the helmet.

FIG. 3 shows a cross-sectional view of the helmet 12 having a rigid outer shell 7 and an inner liner 9 which spaces the outer shell 7 from a user's head 11. It illustrates an exemplary fixation method of both the external sensors 14 and the internal sensors 22. In particular, the external sensors 14 are shown affixed on an outermost surface of the shell 7 and the internal sensors 22 are shown affixed on an innermost surface of the inner liner 9 so as to come in contact with the user's head 11.

Figure 4:
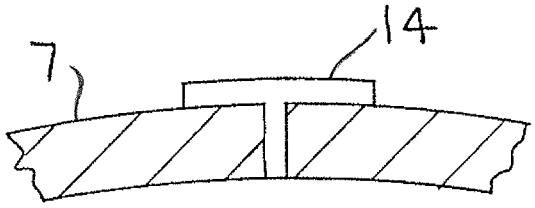
FIG. 4 is an enlarged cross-sectional view of an exemplary embodiment of an external sensor of the present invention that is partially positioned in a hole through the rigid outer shell.

FIG. 4 shows a cross-sectional view of an exemplary external sensor mounted on the rigid outer shell 7. In particular, small diameter holes (e.g., smaller than the current screw holes already used in the helmets) are provided on the outer shell 7. The external sensor 14 is shown having a head portion and a shank portion, with the head portion positioned on the exterior side of the outer shell 7, and the shank portion located in the hole. In this manner, the external sensors may be securely mounted on the helmet, while also providing a passage for wires to pass through (the shank portion) into the helmet, where the receiver is preferably located. It is appreciated that the holes may be optionally countersunk so the head portion of the external sensor is flush with the exterior surface of the outer shell 7.

Figure 5:
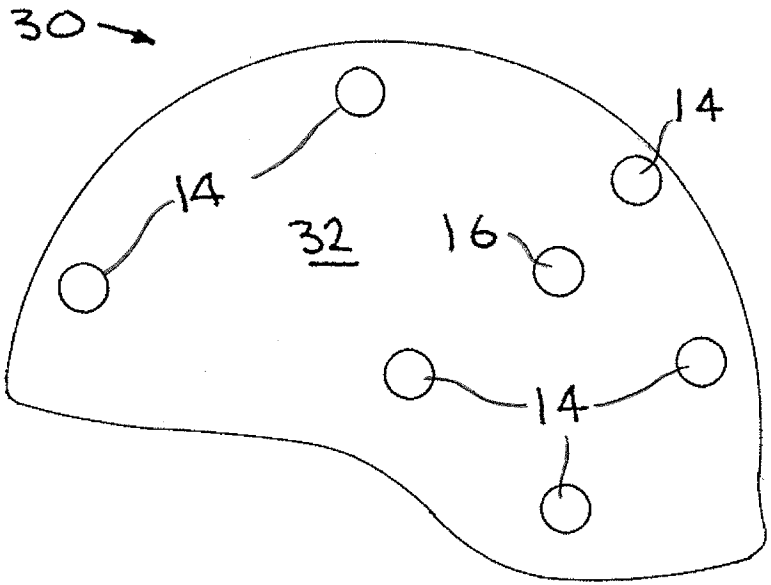
FIG. 5 is a perspective view of an exemplary set of external sensors provided on a helmet slip cover which may be placed over the rigid outer shell of a helmet.

FIG. 5 shows another embodiment of a helmet blastometer 30, using an alternate method of securing the external sensors 14 to the rigid outer shell of the helmet. In particular, a stretchable mesh, netting, or slip cover 32 is used with the external sensors attached thereon. The slip cover 32 is capable of being placed over the rigid outer shell. It can be "one size fits all." Furthermore, because the external sensors are preferably immobilized on the outer shell 7, separate fastening implements may be additionally used to secure the external sensors after positioning the slip cover 32 on the helmet. In this regard, various fastening methods may be used, including for example clamping, bonding, fastening, etc. using conventional clamps, bonds, fasteners. It is notable that the relative spatial positions of the external sensors on the helmet must be known, so as to perform the blast parameter determinations as previously discussed. While the external sensors are preferably rigidly secured to the outer shell during manufacture, as shown in FIGS. 3 and 4, in the alternative the external sensors may be arbitrarily placed on the helmet using the slip cover 32, and, for example, spatial position sensors used to correlate their spatial positions.

Figure 6:
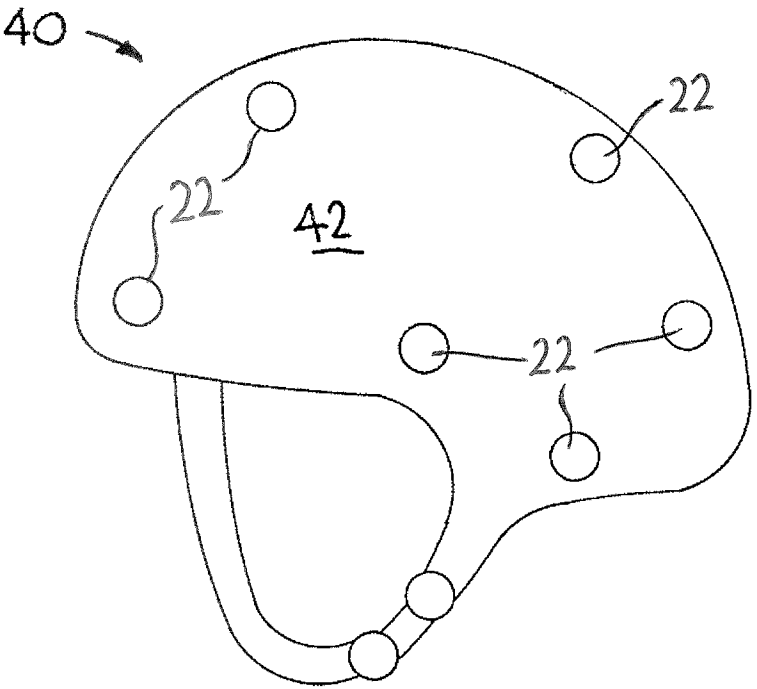
FIG. 6 is a perspective view of an exemplary set of internal sensors provided on an inner liner cap, over which a rigid outer shell may be worn.

FIG. 6 shows a perspective view of another exemplary embodiment of a helmet blastometer 40, with a set of internal sensors 22 provided on an inner liner cap 42 of a helmet, over which a rigid outer shell of the helmet (not shown) may be worn.

Figure 7:
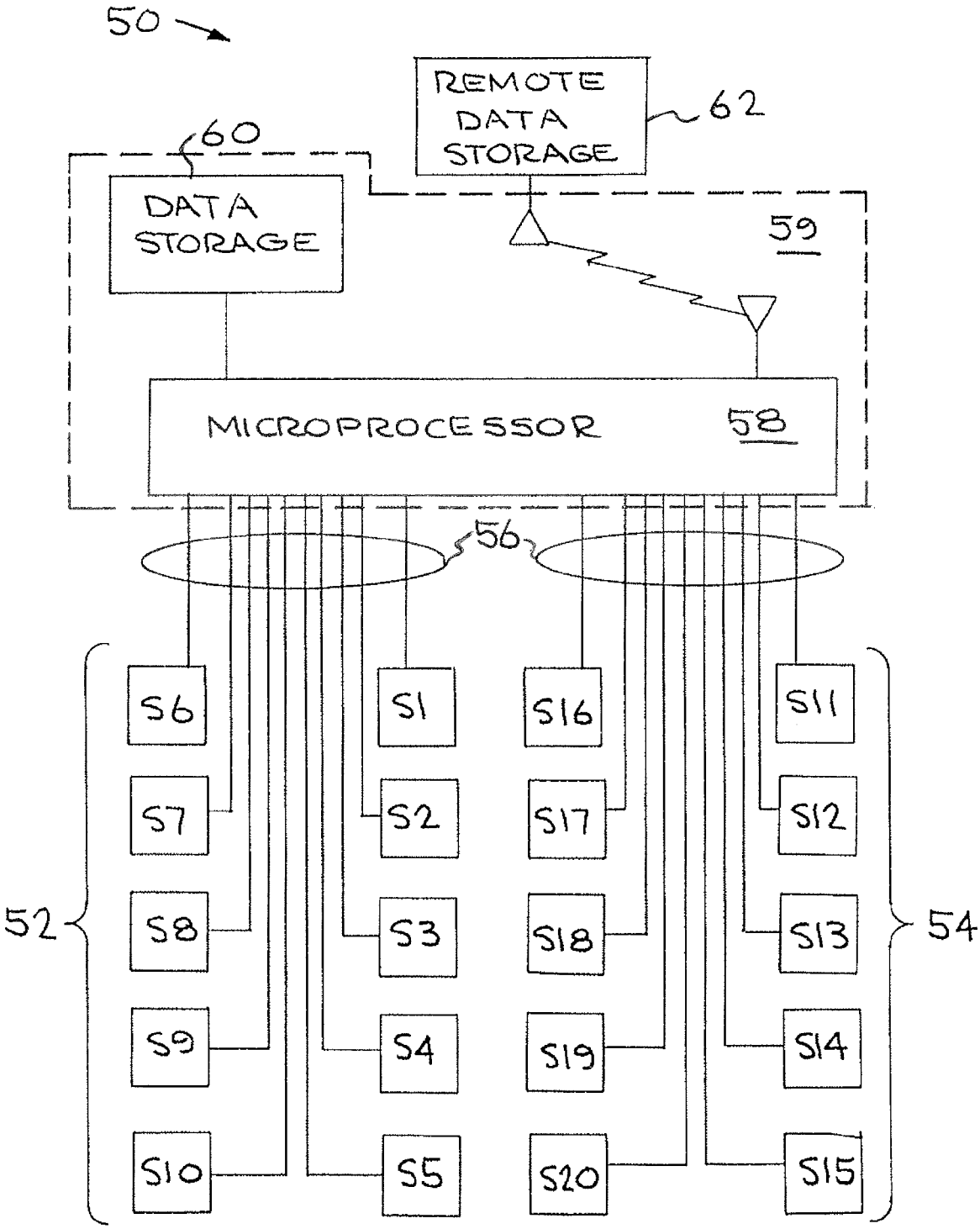
FIG. 7 is an electrical schematic diagram of an exemplary embodiment of the helmet blastometer having both sets of external and internal sensors operably connected to a receiver and processor.

FIG. 7 shows a schematic electronic diagram of an exemplary embodiment of the helmet blastometer of the present invention. A set of external sensors is indicated at 52 and include sensors S1-S10, and a set of internal sensors is indicated at 54 and include sensors S11-S20. It is appreciated that each of the external sensors include a positive pressure change TOA gage, and optionally a second negative pressure change TOA gage. Each of the sensors S1-S20 are connected by conductors 56 to a receiver 59 for transmitted the respective signals upon a triggering event. The receiver 59 is shown having a microprocessor 58 which processes the received signals. In the receiver, the blast exposure data (i.e. the TOA signals and contact stress signals) need not be additionally processed, and rather simply stored in an onboard data storage device 60 for later download to an offline system via a digital readout, or transmitted to a remote system indicated as a remote data storage device 62. In the alternative, the blast exposure data may be analyzed onboard the receiver to determine blast parameters, and subsequently stored in the onboard data storage device 60 or transmitted to the remote data storage device. In either case, the collected data may be used in the development of biological damage thresholds based on field injury data.

In the alternative, pre-determined, known biological injury thresholds may be employed in conjunction with the collected data measurements to rapidly diagnose/indicate whether or not the user (e.g. soldier) had been exposed to a dangerous blast. Firmware, for example, may be used which incorporates "lockouts" so that blast conditions below the predetermined biTBI limit would not trigger the system. Confirmation of a blast of sufficient magnitude and duration for a given direction would trigger the warning device, which could be a visual, aural or other method of warning, such as a biTBI warning dot or dots on the exterior of the helmet and/or the transmission of an identifying RF signal to a nearby receiver. In this manner, the indicator can provide a Yes-No response based on known biological damage thresholds, and may employ.

Figure 8:
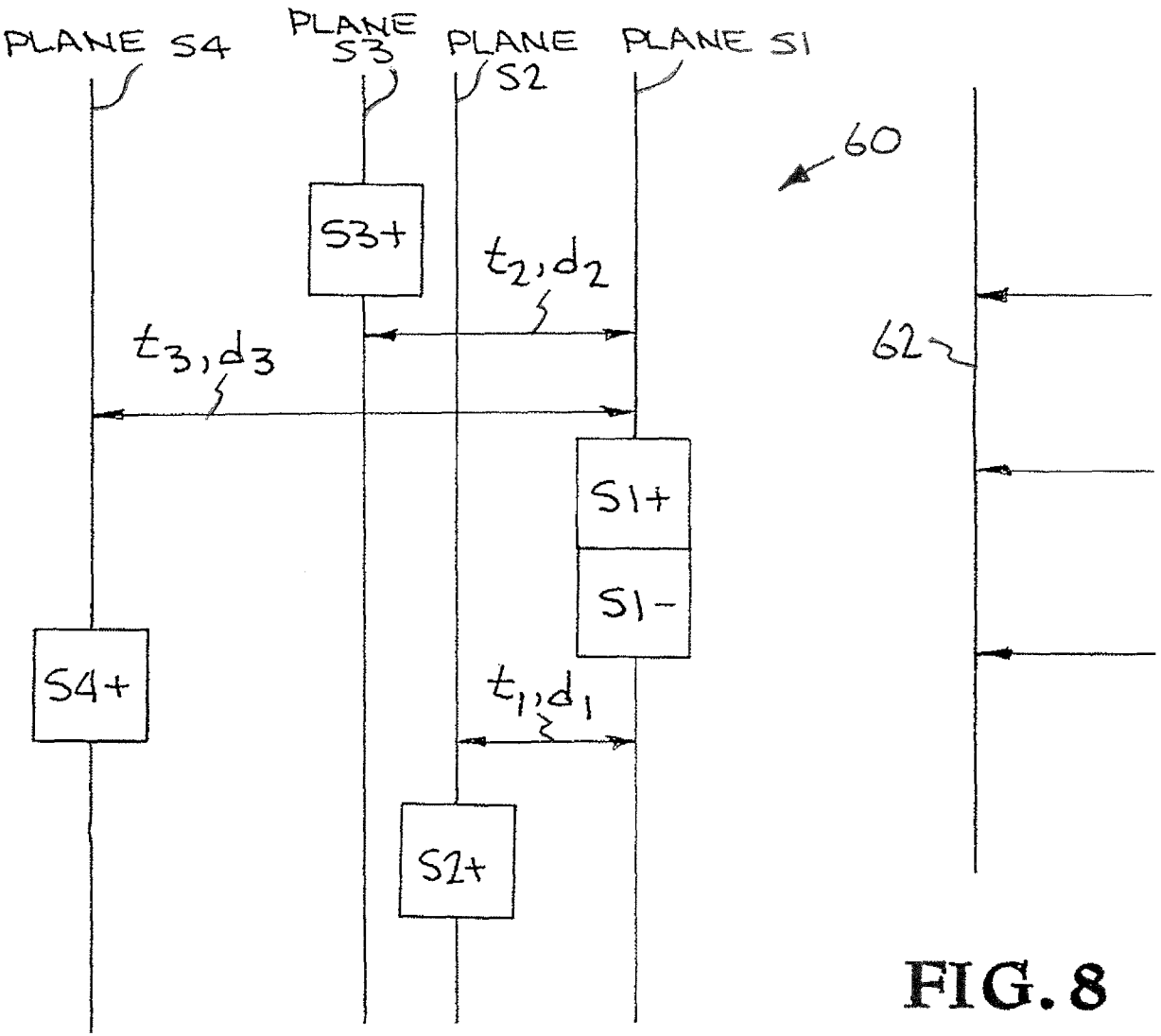
FIG. 8 is a schematic diagram of variously positioned external sensors of the helmet blastometer encountering a blast wavefront.
Figure 9:
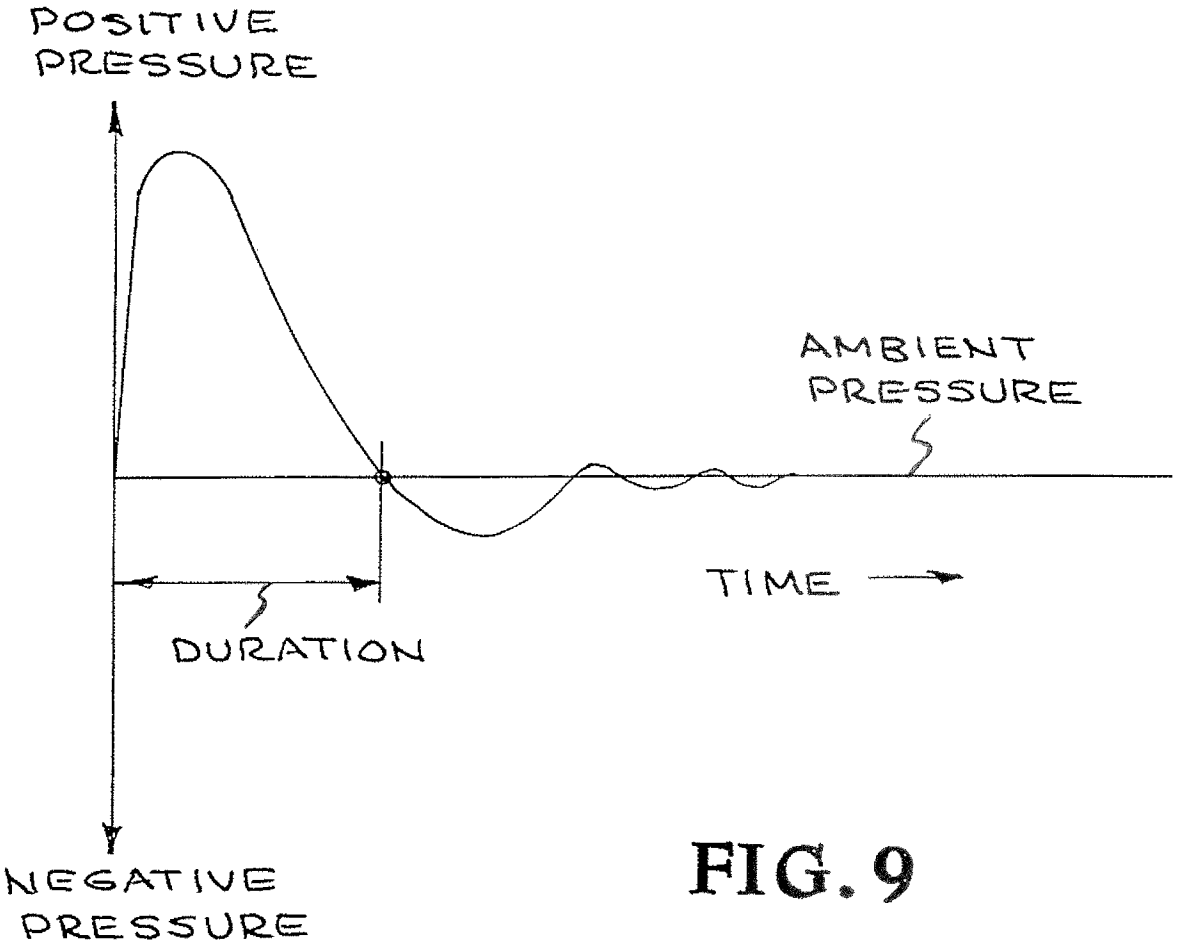
FIG. 9 is a graph illustrating the amplitude of a typical blast wave front over time.

And FIG. 8 shows a schematic diagram 60 of variously positioned external sensors S1-S4 of the helmet blastometer encountering a blast wavefront 62. In particular, sensor S1 is a dual gage sensor, designated as $S1_{(+)}$ and $S1_{(-)}$, while sensors S2-S4 are all positive-pressure-change TOA gages, and therefore designed with a (+) subscript. It is appreciated that the relative locations and distances of each of the external sensors are easily determined using various techniques known in the art, such as by identifying each sensor location on a 3D Cartesian coordinate system, polar coordinate system, etc. As such, and with the time of arrival (trigger times) data, temporal correlations can be made to determine the time intervals, such as t1-t3, and relative distances d1-d3 of the external sensors, as well as the blast direction, and velocity. It is appreciated that blast directionality defines each of the sensor planes S1-S4, since the sensor planes are orthogonal to the blast direction and parallel to the blast wave (characterized as a moving plane).

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

We claim:

1. A helmet blastometer comprising:

a helmet having a rigid outer shell;

a plurality of external sensors connected to the rigid outer shell at various locations thereof, with each external sensor comprising a time-of-arrival (TOA) gage that produces a TOA signal only in response to a blast-induced positive pressure change above a predetermined threshold pressure ("positive-pressure-change TOA signal"); and a receiver operably connected to receive the TOA signals from the TOA gages.

2. The helmet blastometer of claim 1, wherein the receiver includes a process adapted to determine blast presence and at least one of blast direction, blast velocity $U_s$, and blast overpressure magnitude P, wherein the blast presence, the blast direction and the blast velocity U, are determined by temporal correlations of the positive-pressure-change TOA signals, and the blast overpressure magnitude is approximated from the blast velocity U, according to the equation $$U_s = c_o\left(1 + \frac{6P}{7P_o}\right)^{0.5}$$

where $c_o$ is the ambient sound speed in air and $P_o$ is the ambient pressure.

3. The helmet blastometer of claim 1, wherein at least one of the external sensors is a dual-gage external sensor further comprising a second TOA gage that produces a TOA signal only in response to a blast-induced negative pressure change below a predetermined threshold pressure ("negative-pressure-change TOA signal").

4. The helmet blastometer of claim 3, wherein the receiver includes a processor for determining blast presence and at least one of blast direction, blast velocity $U_s$, blast overpressure magnitude P, and blast duration, wherein the blast presence, the blast direction, and the blast velocity $U_s$ are determined by temporal correlations of the positive-pressure-change TOA signals, the blast overpressure magnitude P is approximated from the blast velocity $U_s$ according to the equation $$U_s = c_o\left(1 + \frac{6P}{7P_o}\right)^{0.5}$$

where $c_o$ is the ambient sound speed in air and $P_o$ is the ambient pressure, and the blast duration is determined from a time interval between the positive-pressure-change TOA signal and the negative-pressure-change TOA signal received from the dual-gage external sensor.

5. The helmet blastometer of claim 1, wherein the helmet has an inner liner which spaces the rigid outer shell from a user's head;

further comprising a plurality of internal sensors connected to the inner liner at various locations thereof, with each internal sensor comprising a contact stress gage which measures contact stress between the inner liner and the user's head and produces a corresponding contact stress signal; and wherein the receiver is operably connected to receive the contact stress signals from the contact stress gages.

6. A helmet blastometer comprising:

a helmet having a rigid outer shell;

a plurality of external sensors connected to the rigid outer shell at various locations thereof, with each external sensor comprising a time-of-arrival (TOA) gage that produces a TOA signal only in response to a blast-induced positive pressure change above a predetermined threshold pressure ("positive-pressure-change TOA signal"); and a receiver operably connected to receive the TOA signals from the TOA gages, said receiver including a processor adapted to determine blast presence and at least one of blast direction, blast velocity $U_s$, and blast overpressure magnitude P, wherein the blast presence, the blast direction and the blast velocity $U_s$ are determined by temporal correlations of the positive-pressure-change TOA signals, and the blast overpressure magnitude is approximated from the blast velocity $U_s$ according to the equation $$U_s = c_o\left(1 + \frac{6P}{7P_o}\right)^{0.5}$$

where $c_o$ is the ambient sound speed in air and $P_o$ is the ambient pressure, and wherein the processor is also adapted to determine that blast induced traumatic brain injury (biTBI) has likely been sustained upon determining that at least one of the blast direction, the blast velocity, and the blast overpressure magnitude has satisfied a corresponding predetermined biTBI threshold.

7. The helmet blastometer of claim 6, further comprising a biTBI warning indicator which is activated upon a determination by the processor that biTBI has likely been sustained.

8. The helmet blastometer of claim 7, wherein the biTBI warning indicator is a type selected from the group consisting of a visual indicator, an aural indicator, and an RF signal transmitter.

9. A helmet blastometer comprising:

a helmet having a rigid outer shell;

a plurality of external sensors connected to the rigid outer shell at various locations thereof, with each external sensor comprising a time-of-arrival (TOA) gage that produces a TOA signal only in response to a blast-induced positive pressure change above a predetermined threshold pressure ("positive-pressure-change TOA signal"), wherein at least one of the external sensors is a dual-gage external sensor further comprising a second TOA gage that produces a TOA signal only in response to a blast-induced negative pressure change below a predetermined threshold pressure ("negative-pressure-change TOA signal"); and a receiver operably connected to receive the TOA signals from the TOA gages, wherein the receiver includes a processor adapted to determine blast presence and at least one of blast direction, blast velocity $U_s$, blast overpressure magnitude P, and blast duration, wherein the blast presence, the blast direction, and the blast velocity $U_s$ are determined by temporal correlations of the positive-pressure-change TOA signals, the blast overpressure magnitude P is approximated from the blast velocity $U_s$ according to the equation $$U_s = c_o\left(1 + \frac{6P}{7P_o}\right)^{0.5}$$

where $c_o$ is the ambient sound speed in air and $P_o$ is the ambient pressure, and the blast duration is determined from a time interval between the positive-pressure-change TOA signal and the negative-pressure-change TOA signal received from the dual-gage external sensor, and wherein the processor is also adapted to determine that blast induced traumatic brain injury (biTBI) has likely been sustained upon determining that at least one of the blast direction, the blast velocity, the blast overpressure magnitude, and the blast duration has satisfied a corresponding predetermined biTBI threshold.

10. The helmet blastometer of claim 9, further comprising a biTBI warning indicator which is activated upon a determination by the processor that biTBI has likely been sustained.

11. The helmet blastometer of claim 10, wherein the biTBI warning indicator is a type selected from the group consisting of a visual indicator, an aural indicator, and an RF signal transmitter.

12. A helmet blastometer comprising:

a helmet having a rigid outer shell and an inner liner which spaces the rigid outer shell from a user's head;

a plurality of external sensors connected to the rigid outer shell at various locations thereof, with each external sensor comprising a time-of-arrival (TOA) gage that produces a TOA signal only in response to a blast-induced positive pressure change above a predetermined threshold pressure ("positive-pressure-change TOA signal");

a plurality of internal sensors connected to the inner liner at various locations thereof; with each internal sensor comprising a contact stress gage which measures contact stress between the inner liner and the user's head and produces a corresponding contact stress signal; and a receiver operably connected to receive the TOA signals from the TOA gages and operably connected to receive the contact stress signals from the contact stress gages, wherein the receiver includes a processor adapted to determine blast presence and at least one of blast direction, blast velocity $U_s$, and blast overpressure magnitude P, wherein the blast presence, the blast direction, and the blast velocity $U_s$ are determined by temporal correlations of the positive-pressure-change TOA signals, and the blast overpressure magnitude P is approximated from the blast velocity $U_s$ according to the equation $$U_s = c_o\left(1 + \frac{6P}{7P_o}\right)^{0.5}$$

where $c_o$ is the ambient sound speed in air and $P_o$ is the ambient pressure, and adapted to determine that blast induced traumatic brain injury (biTBI) has likely been sustained upon determining that at least one of the blast direction, the blast velocity, the blast overpressure magnitude, and the contact stress has satisfied a corresponding predetermined biTBI threshold.

13. The helmet blastometer of claim 12, further comprising a biTBI warning indicator which is activated upon a determination by the processor that biTBI has likely been sustained.

14. The helmet blastometer of claim 13, wherein the biTBI warning indicator is a type selected from the group consisting of a visual indicator, an aural indicator, and an RF signal transmitter.

15. A helmet blastometer comprising:

a helmet having a rigid outer shell and an inner liner which spaces the rigid outer shell from a user's head;

a plurality of external sensors connected to the rigid outer shell at various locations thereof, with each external sensor comprising a time-of-arrival (TOA) gage that produces a TOA signal only in response to a blast-induced positive pressure change above a predetermined threshold pressure ("positive-pressure-change TOA signal"), and at least one of the external sensors is a dual-gage external sensor further comprising a second TOA gage that produces a TOA signal only in response to a blast-induced negative pressure change below a predetermined threshold pressure ("negative-pressure-change TOA signal");

a plurality of internal sensors connected to the inner liner at various locations thereof, with each internal sensor comprising a contact stress gage which measures contact stress between the inner liner and the user's head and produces a corresponding contact stress signal; and a receiver operably connected to receive the TOA signals from the TOA gages and the contact stress signals from the contact stress gages.

16. A helmet blastometer comprising:

a helmet having a rigid outer shell and an inner liner which spaces the rigid outer shell from a user's head;

a plurality of external sensors connected to the rigid outer shell at various locations thereof with each external sensor comprising a time-of-arrival (TOA) gage that produces a TOA signal only in response to a blast-induced positive pressure change above a predetermined threshold pressure ("positive-pressure-change TOA signal"), and at least one of the external sensors is a dual-gage external sensor further comprising a second TOA gage that produces a TOA signal only in response to a blast-induced negative pressure change below a predetermined threshold pressure ("negative-pressure-change TOA signal");

a plurality of internal sensors connected to the inner liner at various locations thereof with each internal sensor comprising a contact stress gage which measures contact stress between the inner liner and the user's head and produces a corresponding contact stress signal; and a receiver operably connected to receive the TOA signals from the TOA gages and the contact stress signals from the contact stress gages, wherein the receiver includes a processor adapted to determine blast presence and at least one of blast direction, blast velocity $U_s$, blast overpressure magnitude P, and blast duration, wherein the blast presence, the blast direction, and the blast velocity $U_s$ are determined by temporal correlations of the positive-pressure-change TOA signals, the blast overpressure magnitude P is approximated from the blast velocity $U_s$ according to the equation $$U_s = c_o\left(1 + \frac{6P}{7P_o}\right)^{0.5}$$

where $c_o$ is the ambient sound speed in air and $P_o$ is the ambient pressure, and the blast duration is determined from a time interval between the positive-pressure-change TOA signal and the negative-pressure-change TOA signal received from the dual-gage external sensor, and adapted to determine that blast induced traumatic brain injury (biTBI) has likely been sustained upon determining that at least one of the blast direction, the blast velocity, the blast overpressure magnitude, the blast duration, and the contact stress has satisfied a corresponding predetermined biTBI threshold.

17. The helmet blastometer of claim 16, further comprising a biTBI warning indicator which is activated upon a determination by the processor that biTBI has likely been sustained.

18. The helmet blastometer of claim 17, wherein the biTBI warning indicator is a type selected from the group consisting of a visual indicator, an aural indicator, and an RF signal transmitter.

19. A helmet blastometer comprising:

a helmet having a rigid outer shell;

a plurality of internal sensors connected to an inner part of the helmet at various locations thereof, with each internal sensor comprising a contact stress gage which measures contact stress between the helmet liner and the user's head and produces a corresponding contact stress signal; and a receiver operably connected to receive the contact stress signals.

20. The helmet blastometer of claim 19, wherein the receiver includes a processor for determining that blast induced traumatic brain injury (biTBI) has likely been sustained upon determining that the contact stress signals has satisfied a predetermined biTBI threshold.

* * * * *